US006313386B1

(12) United States Patent
Capobianco et al.

(10) Patent No.: US 6,313,386 B1
(45) Date of Patent: Nov. 6, 2001

(54) MUSIC BOX WITH MEMORY STICK OR OTHER REMOVABLE MEDIA TO CHANGE CONTENT

(75) Inventors: Anthony Capobianco; John Timothy Nolan, both of Cape Coral, FL (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 09/783,765

(22) Filed: Feb. 15, 2001

(51) Int. Cl.[7] ..... G10H 7/00

(52) U.S. Cl. ..... 84/600; 84/602; 84/94.2; 446/303

(58) Field of Search ..... 84/94.1–100, 600–602, 84/703; 446/303

(56) References Cited

U.S. PATENT DOCUMENTS 5,166,851 11/1992 Jacobson ..... 360/137
5,485,068 * 1/1996 Vaught .
5,495,151 * 2/1996 Lu .
5,498,833 3/1996 Huang ..... 84/94.1
5,552,896 9/1996 Yoshida ..... 386/105
5,668,414 * 9/1997 Takahashi et al. .
5,696,332 * 12/1997 Yang ..... 84/95.2
5,973,250 10/1999 Zirille et al. ..... 84/600

* cited by examiner

*Primary Examiner*—Jeffrey Donels
(74) *Attorney, Agent, or Firm*—Mayer Fortkort & Williams, PC; Michael P. Fortkort; Karin L. Williams, Esq.

(57) ABSTRACT

One exemplary embodiment of the present invention includes an apparatus for playing music. The apparatus includes a manually movable spring, a generator mechanically coupled to the manually movable spring, and a controller electrically coupled to the generator. The apparatus also includes a memory interface coupled to the controller, the memory interface, in an operative configuration, coupled to a removable memory device containing digital music data. The apparatus can further include an audio interface coupled to the controller, the audio interface, in an operative configuration, coupled to a speaker.

26 Claims, 3 Drawing Sheets

MUSIC BOX WITH MEMORY STICK OR OTHER REMOVABLE MEDIA TO CHANGE CONTENT

FIELD OF THE INVENTION

The present invention relates generally to devices, methods, and systems for playing music, and more particularly to at least one device, method, and system for playing music from a digital storage media.

BACKGROUND

Known music boxes tend to have poor audio quality. Moreover, known music boxes tend to have a very limited and unchangeable choice of music.

SUMMARY OF THE INVENTION

One exemplary embodiment of the present invention includes an apparatus for playing music. The apparatus includes a manually movable spring, a generator mechanically coupled to the manually movable spring, and a controller electrically coupled to the generator. The apparatus also includes a memory interface coupled to the controller, the memory interface, in an operative configuration, coupled to a removable memory device containing digital music data. The apparatus can further include an audio interface coupled to the controller, the audio interface, in an operative configuration, coupled to a speaker.

DETAILED DESCRIPTION

Certain embodiments of the present invention can advantageously provide a digital music box that aesthetically simulates classic mechanical music boxes, yet provides the greatly improved audio quality of a digital music player. Moreover, certain embodiments of the present invention can allow a user to remove digital music-containing media from the music box and replace that media with a media containing different music. Further, certain embodiments of the present invention can avoid the use of batteries, and instead rely upon a manually wound spring to provide mechanical energy to a small generator that supplies electrical power to the circuitry of the music box.

Figure 1:
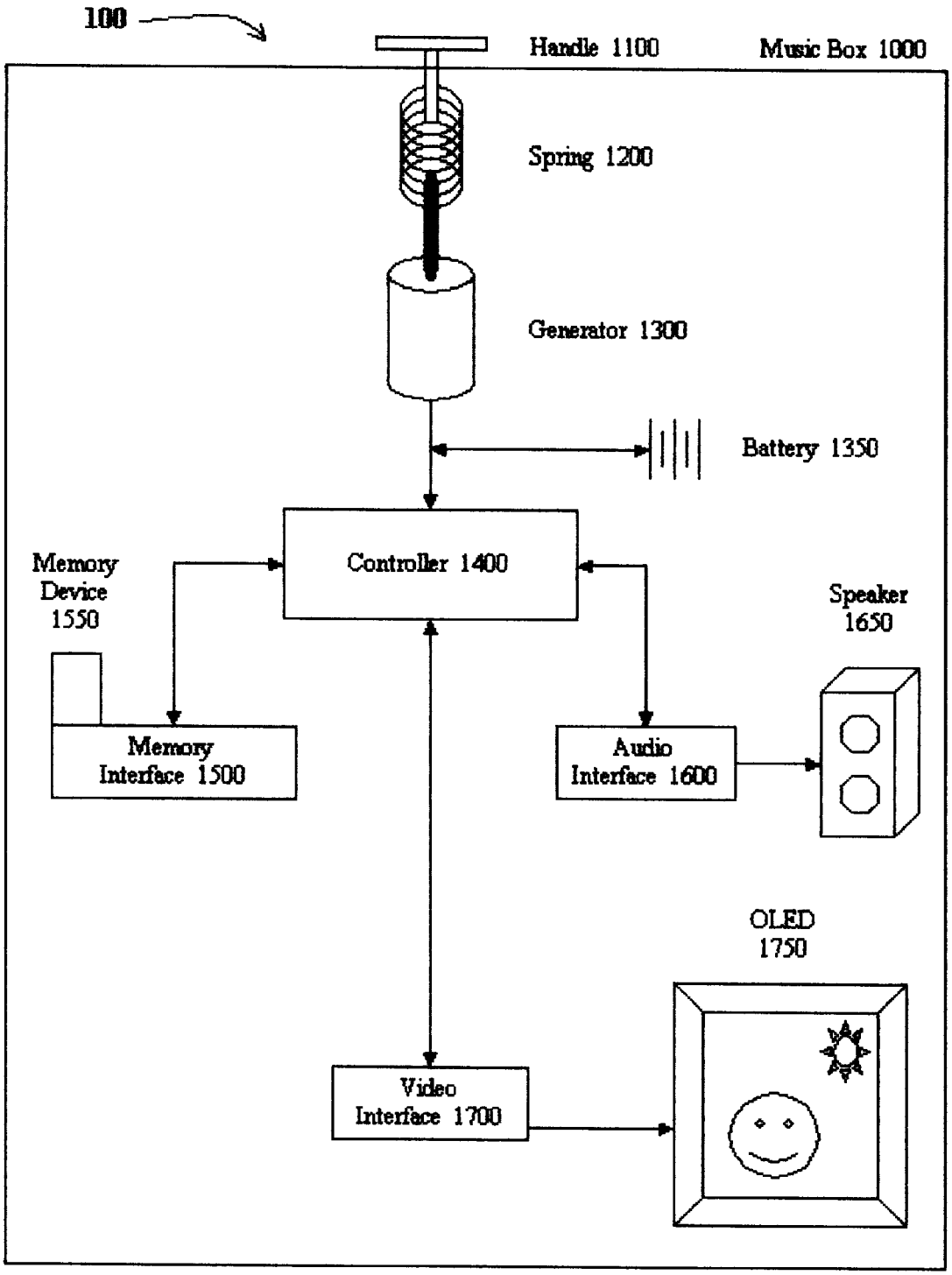
FIG. 1 is a block diagram of an exemplary embodiment of a system of the present invention.

FIG. 1 is a block diagram of an exemplary embodiment of a system 100 of the present invention. System 100, or any of its components, can be contained in an enclosure 1000, such as a music box, which can include a handle 1100 or the like for manually applying a mechanical force to a spring 1200. The work performed by the application this mechanical force can be stored in spring 1200 as potential mechanical energy. For example, handle 1100 can be grasped to wind-up a spiral or coil spring 1200. As another example, handle 1100 can be pushed or pulled linearly to apply an axial compressive or expansive force to a helical spring 1200. The material of spring 1200 can be any traditional spring material, such as carbon steel, and/or any shape memory material, such as niconel. Other spring styles and materials can be employed as well, such as those described in Marks Handbook of Mechanical Engineering, which is incorporated by reference herein in its entirety.

In any event, as spring 1200 returns to its natural position, spring 1200 can release the vast majority of the originally applied mechanical energy by, either directly or indirectly (such as via a gearbox (e.g., a planetary gear arrangement, a rack and pinion arrangement, etc.), turning an input shaft of a well-known fractional horsepower generator 1300. From this supplied mechanical energy, generator 1300 can generate electrical energy. Although generator 1300 can be replaced by an alternator whose AC output is converted into DC power, for example by a diode bridge and/or a rectifier, for simplicity, only generator 1300 is referred to henceforth.

The electrical energy of generator 1300 can be stored in a battery 1350, and/or provided directly to controller 1400. The electricity from generator 1300, and/or the electricity provided to controller 1400, can be regulated by any known power, voltage, and/or current regulator (not shown in FIG. 1). Likewise, any known power, voltage, and/or current protector (not shown in FIG 1), such as an isolation transformer, surge protector, thyristor, breaker, and/or fuse, can protect controller 1400.

Also, a mechanical switch (not shown in FIG. 1) can be utilized to prevent the movement of spring 1200 and/or generator 1300. Likewise, an electrical switch (not shown in FIG. 1) can be utilized to prevent the flow of power from generator 1300 and/or battery 1350.

Coupled to controller 1400 can be a memory interface 1500, which can be coupled to a memory device 1550, such as, for example, ROM, RAM, floppy disk, hard disk, CD, DVD, MD, tape, flash memory, Memory Stick™ removable memory device, etc. In some embodiments, memory device 1550 is removable by the user. In other embodiments, memory device 1550 is non-removable by the user. Memory device 1550 can contain digital audio data, such as digital voice and/or digital music that has been stored in, for example, the MP3 format using OpenMG™ software. OpenMG™ software is a copyright-protection software platform used to manage recording and playback of digital audio content. It can convert music data from CDs, as well as MP3 and other formats into ATRAC3 format, which can then be transferred to a portable player. Memory device 1550 can also incorporate MagicGate™ software technology, which is an intelligent new copyright protection technology that allows encryption and authentication of encrypted data between products and media. Both OpenMG™ software and MagicGate™ software can comply with the international Secure Digital Music Initiative (SDMI).

In addition to audio data, memory device 1550 can contain digital video, graphic, animation, and/or photographic data stored in, for example, the MPEG, JPEG, QuickTime™ video file format, Flash™ video rile format, HTML, SGMT., and/or BNP formats. Moreover, in certain embodiments, memory device 1550 can contain analog data.

Controller 1400 can also be coupled to an audio interface 1600, which can be coupled to one or more audio output devices 1650, such as for example, a wired speaker, a wireless speaker, and/or a headphone. Thus, for example, controller 1400 can decode MP3 music data stored on memory device 1550, convert the resulting digital signal to analog, amplify the resulting analog signal, and output that signal in stereo to a pair of wireless speakers 1650.

Controller 1400 can also be coupled to a video interface 1700, which can be coupled to one or more known video devices 1750 (e.g., an LCD, an organic LCD, an organic light-emitting diode display (OLED), etc.). Thus, for example, controller 1400 can decode QuickTime™ video file format video data stored on memory device 1550 and output the resulting signal via video interface 1700 to an OLED 1750.

Video device 1750 can be adapted to show a famous person, place, or color pattern either in an action state, steady state, or a combination thereof. Further, the video and/or graphical image provided on video device 1750 can be synchronized with audio provided by audio output devices 1650. Also, the visuals provided by video display 1750, as well as the sound content provided by audio output device 1650, can be set to repeat at a predetermined interval. One potential advantage of using OLED's for the video display is the technology's ability to take on unique shapes and forms, which can be designed to fit enclosure 1000.

In part because of the adaptability of video display 1750, enclosure 1000 can be physically constructed in such a way as to lend itself to be a collectable item. For example, enclosure 1000 can be designed to look like a famous person or place. By way of further example, enclosure 1000 can be a figurine shaped like a popular musical star. Yet further examples of embodiments of enclosure 1000 can be found in U.S. Pat. No. 5,973,250 (Zirille), which is incorporated herein by reference in its entirety.

Although not shown in FIG. 1, enclosure 1000 can include a lid having a latch-like switch, such that when the lid is raised, any pre-stored energy in spring 1200 can be released to generator 1300, and thereby begin the playing of the stored audio and/or video data. The lid of enclosure 1000 can contain video display 1750. Moreover, the lid and/or another portion of enclosure 1000 can have a changeable external cover (e.g., "skin") that portrays, for example, a musical theme.

Although not shown in FIG. 1, a user interface can be coupled to controller 1400 and can provide a user of system 100 with a mechanism for entering commands, such as, for example, repeat, skip forward, next song, freeze video, and/or next video, etc. This user interface can also provide the user with tactile, audio, and/or visual feedback concerning whether system 100 and/or controller 1400 have received the command. This feedback can also provide status information concerning system 100, such as how much time remains before spring power is exhausted, what volume the system is outputting, the name of the song currently playing, the name of the artist starring on a currently playing video, etc.

Figure 2:
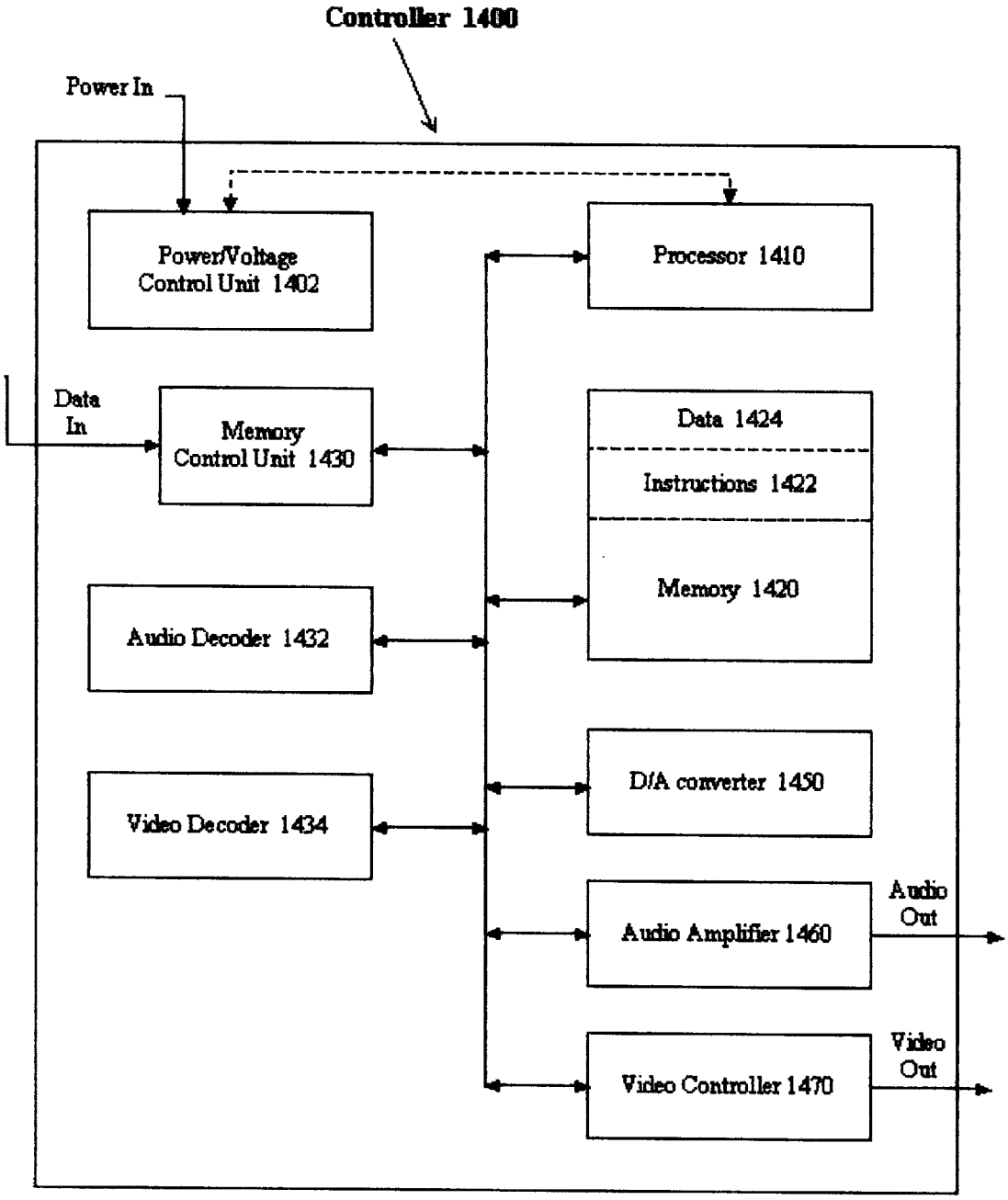
FIG. 2 is a block diagram of an exemplary embodiment of a controller 1400 of the present invention.

FIG. 2 is a block diagram of an exemplary embodiment of controller 1400 of FIG. 1. Power can enter controller 1400 at electricity control unit 1402 and thereby be supplied, as necessary and/or appropriate, to other components of controller 1400. Electricity control unit 1402 can regulate power, voltage, and/or current. Thus, power can be provided from electricity control unit 1402 to processor 1410, with which certain electricity control information can be exchanged as well.

Processor 1410 can be a general-purpose microprocessor and/or a digital signal processor. Processor 1410 can execute instructions 1422 stored in memory 1420, which can also store data 1424. In certain embodiments, memory 1420 can be firmware, such as ROM, Flash ROM, EPROM, etc.

Audio and/or video data can enter controller 1400 via memory control unit 1430. When audio data is encoded, audio decoder 1432 can decode the data. Likewise, when video data is encoded, video decoder 1434 can decode that data. Other controllers, not shown in FIG. 2, can be utilized as necessary for graphical, photographical, and/or animation data.

For audio data, digital to analog converter 1450 can convert a decoded digital audio signal to an analog format. Then, audio amplifier 1460 can boost the power of the resulting analog audio signal prior to outputting the signal to an audio interface (shown in FIG. 1) connected to one or more audio output devices (shown in FIG. 1).

For video data, video controller 1470 can manage a decoded digital video signal prior to outputting the signal to a video interface (shown in FIG. 1) connected to one or more video display devices (shown in FIG. 1).

Controller 1400 can be adapted to decode audio data, such as music data, formatted using adaptive transform acoustic coding (ATRAC). This format is described in U.S. Pat. No. 5,552,896 (Yoshida), which is incorporated herein by reference in its entirety. Through a combination of various techniques including psychoacoustics, sub-band coding, and transform coding, ATRAC can code digital audio with virtually no perceptual degradation in sound quality. Listening tests indicate that the difference between ATRAC sound and the original source are not perceptually different and that ATRAC does not reduce the sound quality. Furthermore, an ATRAC decoding system is sufficiently compact to be installed in portable consumer products such as described herein. Also, in certain embodiments, controller 1400 can decrypt encrypted data using any known and appropriate decryption technique. Further, in certain embodiments, controller 1400 can decompress compressed data using any known and appropriate decompression technique.

Controller 1400 can be embodied as a large-scale integrated (LSI) circuit component. For example, currently available LSI circuit components can be modified to enable construction of controller 1400. An example is a STA015 MPEG Layer III decoder from STMicroelectronics, Inc. This device has low power consumption, typically 85 mW at 2.4 V while decoding a 320kbits/s bitstream; compact SO28, FP44 BGA8×8 packages; and is based on a VLIW DSP core specially optimized for audio and/or video applications. This device can also serve as an ADPCM codec.

Figure 3:
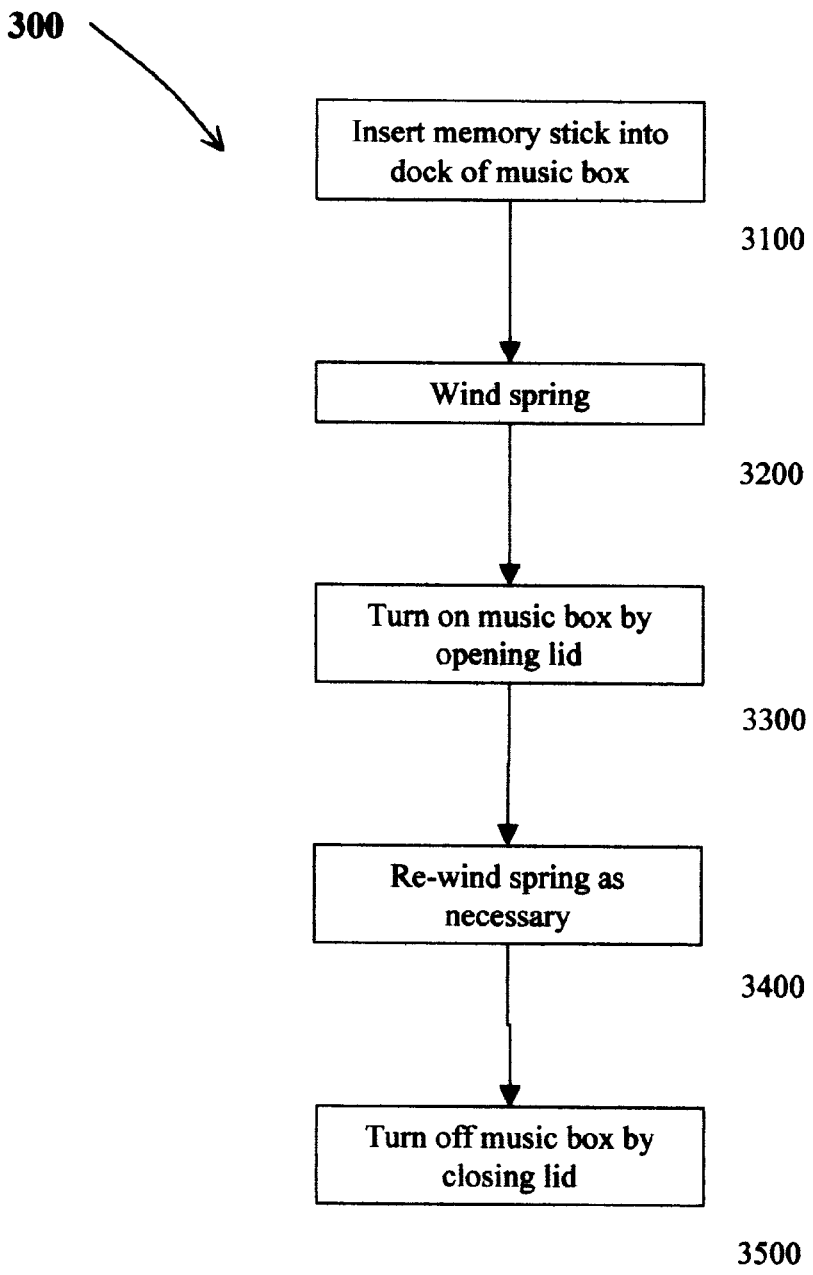
FIG. 3 is a flowchart of an exemplary embodiment of a method 300 of the present invention.

FIG. 3 is a flowchart of an embodiment of a method 300 of the present invention. At activity 3100, a Memory Stick™ removable memory device or other removable media is inserted into a dock (memory interface) of the music box, At activity 3200, the spring of the music box is energized, such as by winding. At activity 3300, playing of the music box is initiated, such as by opening a lid of the music box, or flipping a switch.

At activity 3400, additional mechanical energy is manually supplied to the spring, such as by re-winding the spring. At activity 3500, the playing of the music box can be stopped by a release of the mechanical energy stored in the spring, closing the lid of the music box, or flipping a switch to the "off" position.

Thus, certain embodiments of the present invention can provide a digital music box that simulates many features of classic collectable mechanically-powered music boxes, with the exception that the mechanical spring power can first be converted to electrical power before driving a high quality audio decoder amplifier circuit.

According to another aspect of the present invention, an exemplary embodiment of a system for playing digital music includes the above-described mechanically-powered music box as well as a processor-controlled apparatus for downloading digital music data from a computer network, such as the Internet, into the mechanically-powered music box. The digital music data is then stored in the memory of the music box. This enables the memory to be either of the removable or non-removable type, as the memory can be rewritten at any time without necessitating removal from the music box.

The digital music data may in MP3 format or any other music data format. The processor-controlled apparatus may be a personal computer, for example, which can couple to the computer network. The processor-controlled apparatus can be any personal computer capable of accessing the Internet and receiving digital music data. Preferably, the computer includes a data output port.

This processor-controlled apparatus receives digital music data from the computer network and forwards the digital music data to the music box controller for storage in the memory. The processor-controlled apparatus couples to the music box controller via a port on the music box, such as an RS-232 serial data interface, a Universal Serial Bus, a parallel port, or any other Input/Output interface.

As in the above exemplary embodiments, the music box includes a manually movable spring and a generator mechanically coupled to the manually movable spring to generate power for the controller to play the digital music data. The controller is electrically coupled to the generator and to the processorcontrolled apparatus when connected via the data interface. The memory interface is coupled to the controller and to the memory device, which stores the digital music data received via the computer network. An audio interface is coupled to the controller and to a speaker.

It is worthy to note that any reference herein to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Although various embodiments are specifically illustrated and described herein, it will be appreciated that modifications and variations of the invention are covered by the above teachings and are within the purview of the appended claims without departing from the spirit and intended scope of the invention. For example, while several of the embodiments depict the use of specific data formats and storage protocols, any formats for storing and replaying music will suffice. Moreover, while some of the embodiments describe specific embodiments of memory media, any media, including digital and analog media, can be employed by the invention described herein. Furthermore, these examples should not be interpreted to limit the modifications and variations of the invention covered by the claims but are merely illustrative of possible variations.

what is claimed is:

1. An apparatus for playing music, comprising:

a manually movable spring;

a generator mechanically coupled to said manually movable spring;

a controller electrically coupled to said generator;

a memory interface coupled to said controller, said memory interfaces, in an operative configuration, coupled to a removable memory device containing digital music data;

an audio interface coupled to said controller, said audio interface, in an operative configuration, coupled to a speaker; and a display coupled to said controller.

2. The apparatus of claim 1, further comprising:

a switch mechanically coupled to said manually movable spring and, in an operative configuration, adapted to resist a movement of said manually movable spring.

3. The apparatus of claim 1, further comprising:

a switch mechanically coupled to said generator and, in an operative configuration, adapted to resist a movement of said generator.

4. The apparatus of claim 1, further comprising:

a switch electrically coupled to said generator and said controller and adapted to control electrical power from said generator to said controller.

5. The apparatus of claim 1, further comprising:

a switch electrically coupled to said generator and said controller and, in an operative configuration, adapted to resist a flow of electrical power from said generator to said controller.

6. The apparatus of claim 1, further comprising:

a voltage regulator coupled to said generator in an operative configuration adapted to regulate electrical power from said generator.

7. The apparatus of claim 1, wherein said manually movable spring is a wind-up spring.

8. The apparatus of claim 1, wherein said controller includes a memory manager, and further wherein audio and video data enters said controller via said memory manager.

9. The apparatus of claim 1, wherein said controller includes a music data decoder.

10. The apparatus of claim 1, wherein said controller includes a digital music data decoder.

11. The apparatus of claim 1, wherein said controller includes an ATRAC decoder.

12. The apparatus of claim 1, wherein said controller includes a digital to analog converter.

13. The apparatus of claim 1, wherein said controller includes an audio amplifier.

14. The apparatus of claim 1, wherein said controller is constructed as a large scale integrated circuit (LSI).

15. The apparatus of claim 1, further comprising:

a memory device coupled to said memory interface, said memory device containing music data.

16. The apparatus of claim 1, further comprising:

a memory device coupled to said memory interface, said memory device containing copy protected music data.

17. The apparatus of claim 1, further comprising:

a memory device coupled to said memory interface, said memory device containing compressed music data.

18. The apparatus of claim 1, further comprising:

a memory device coupled to said memory interface, said memory device containing MP3 music data.

19. The apparatus of claim 1, further comprising:

a speaker coupled to said audio interface.

20. The apparatus of claim 1, further comprising:

a pair of stereo speakers coupled to said audio interface.

21. The apparatus of claim 1, wherein said display is an organic light emitting diode (OLED) display.

22. The apparatus of claim 1, further comprising:

copy protection instructions within said controller for playing copy protected music data.

23. The apparatus of claim 1, further comprising:

an electrical power storage device coupled to said controller.

24. The apparatus of claim 1, further comprising:

an enclosure surrounding at least said controller.

25. The apparatus of claim 1, further comprising:

a figurine-shaped chassis surrounding at least said controller.

26. A system for playing digital music, comprising:

a) a processor controlled apparatus for coupling to a computer network and for receiving digital music data from the computer network, and b) a mechanically-powered music box including:

(i) a manually movable spring;

(ii) a generator mechanically coupled to said manually movable spring;

(iii) a controller electrically coupled to said generator and to said processor controlled apparatus;

(iv) a memory interface coupled to said controller and coupled to a memory device storing the digital music data;

(v) an audio interface coupled to said controller and coupled to a speaker; and (vi) a display coupled to said controller.

* * * * *

UNITED STATES PATENT AND TRADEMARK OFFICE

CERTIFICATE OF CORRECTION

PATENT NO. : 6,313,386 B1 
DATED : November 6, 2001
INVENTOR(S) : Anthony Capobianco et al.

It is certified that error appears in the above-identified patent and that said Letters Patent is hereby corrected as shown below:

Column 1,
Line 33, after "system", insert -- 100 --.
Line 58, after "application", insert -- of --.

Column 2,
Line 54, change "SGMT." to -- SGML --.

Column 5,
Line 3, after "may", insert -- be --.
Line 24, change "processorcontrolled" to -- processor-controlled --.
Line 62, change "interfaces" to -- interface --.

Signed and Sealed this

Eleventh Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,313,386 B1
DATED : November 6, 2001
INVENTOR(S) : Anthony Capobianco et al.

It is certified that error appears in the above-identified patent and that said Letters Patent is hereby corrected as shown below:

Column 2,
Line 53, after "video (second occurrence), change "rile" to -- file --.

Signed and Sealed this

Sixth Day of July, 2004

JON W. DUDAS
*Acting Director of the United States Patent and Trademark Office*